United States Patent [19]

Thomson et al.

[11] 4,341,261

[45] Jul. 27, 1982

[54] METHOD OF CASTING ELONGATED MEMBERS OF REACTIVE METALS AND REACTIVE METAL ALLOYS

[75] Inventors: Robert Thomson; John R. Emmett, both of Ottawa, Canada

[73] Assignee: Canadian Patents & Dev. Ltd., Ottawa, Canada

[21] Appl. No.: 157,532

[22] Filed: Jun. 9, 1980

[30] Foreign Application Priority Data

Jul. 18, 1979 [CA] Canada ..... 332068

[51] Int. Cl.[3] ..... B22D 11/10

[52] U.S. Cl. ..... 164/475; 164/415; 164/440; 164/471

[58] Field of Search ..... 164/415, 439, 440, 470, 164/475, 471

[56] References Cited

U.S. PATENT DOCUMENTS

| | | | |
|---|---|---|---|
| 2,530,854 | 11/1950 | Brennan | 164/440 |
| 3,794,108 | 2/1974 | Koump | 164/415 |
| 3,894,573 | 7/1975 | Paton et al. | 164/470 X |
| 3,946,794 | 3/1976 | Rakestraw | 164/475 X |

*Primary Examiner*—R. L. Spruill
*Assistant Examiner*—J. Reed Batten, Jr.
*Attorney, Agent, or Firm*—Francis W. Lemon

[57] ABSTRACT

Elongated members of reactive metals and alloys thereof, for example, uranium and alloys thereof, are cast from a crucible containing the molten metal blanketed with an inert gas and non-reactive prepared molten slag, directly into a mould protruding from the crucible. The cast metal is spray cooled with inert gas, which may be liquefied, as it emerges from an outlet end of the mould and is pulled, for example by rollers, into and possibly through an inert gas flushed container directly connected to the mould outlet end.

6 Claims, 2 Drawing Figures

METHOD OF CASTING ELONGATED MEMBERS OF REACTIVE METALS AND REACTIVE METAL ALLOYS

Figure 1:
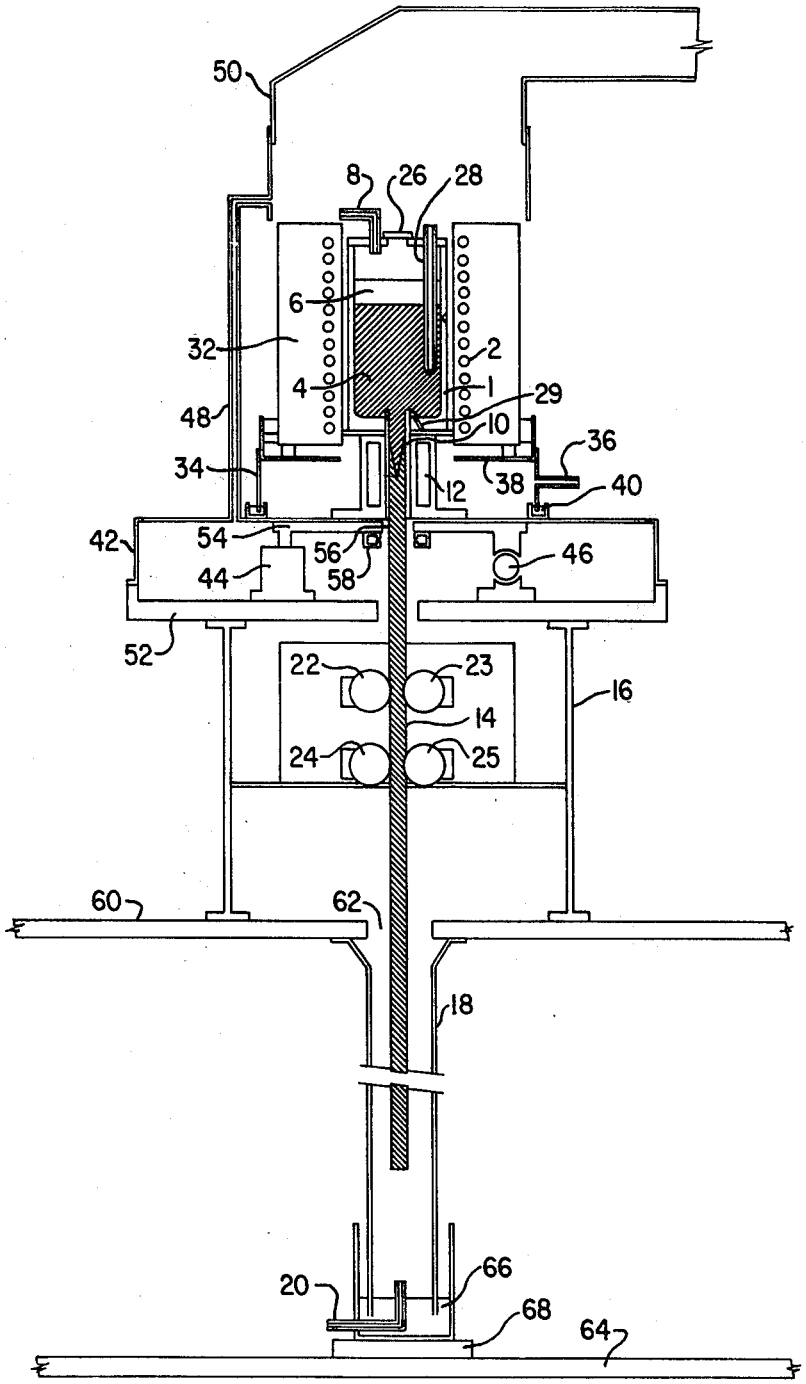

This invention relates to a method of casting elongated members of reactive metals and alloys thereof.

Because of the extremely high reactivity or uranium with oxygen, the conversion of liquid uranium to solid cast shapes is conventionally achieved in vacuum vessels designed for that purpose. Typically, a vacuum melting furnace of 20 to 2000 Kg batch capacity of uranium is used to cast molten uranium and its alloys by pouring it into moulds previously placed inside the vacuum chamber. Apart from the intrinsic economic disadvantage of batch production, the vacuum melting and casting uranium involves a specific radiological hazard in that the highly radioactive daughter elements in the uranium tend to volatilise from the liquid metal and subsequently condense on the cold surfaces of the vacuum system. The resultant high level of surface contamination requires extreme precautionary measures on opening the vacuum system to remove the castings and refurbish the equipment. High $\beta$ particle activities of 10,000 m rem/hr require operator shielding, while the more damaging $\gamma$ particle activity levels of 100 m rem/hr may in fact require that the entire closed vacuum system be left for 4–5 days until this radiation has decayed to safe levels. Thus the radiological hazard created by vacuum melting severely interferes with the productivity of the equipment, and presents severe operator hazard.

In order to cast continuous lengths of product in vacuo, it has been proposed in Canadian Pat. No. 939,483, dated Jan. 8, 1974, that a specially designed vessel be used, having as its principal feature, a series of individually evacuated ports through which the product can exit without deteriorating the high vacuum maintained in the main body of the vessel. This system, while being highly sophisticated and extremely costly to build and operate, suffers from the additional disadvantage of the high levels of radiation referred to above, and should any part or power failure permit air ingress through the open ports, an extremely serious and radiologically hazardous fire would result. Thus it will be seen that in continuous vacuum casting the intrinsic radiological hazard of vacuum melting uranium is not removed.

While the specific technique of continuous casting of uranium described in Canadian Pat. No. 939,483, of open pouring a thin stream of liquid uranium to create a predetermined level of molten metal in a reciprocating graphite mould may be commercially useful it nevertheless has serious limitations in that:

(a) controlling the size and geometry of the pouring stream entering the mould is difficult;
(b) controlling the level of liquid in the mould is difficult;
(c) the size and shape of product that can in practice be cast is limited. Open stream techniques such as those described in the Canadian Patent become unworkable with mould section sizes less than 1.5×1.5 sq. in.; and
(d) the surface quality of the casting is poor.

According to the present invention there is provided a method of casting elongated members of reactive metals and reactive metal alloys comprising:

(a) melting the metal to be cast into a molten state in a vessel with fused slag while blanketing the surface of these contents of the vessel with inert gas;
(b) maintaining the metal in the vessel in a molten state while allowing the molten metal to flow directly from the vessel into an upstream end of a mould protruding into and sealed to a bottom portion of the vessel to maintain the upstream end of the mould flooded with molten metal;
(c) cooling a downstream portion of the mould so that the molten metal issues therefrom as a cast, elongated member; and
(d) controlling the rate of casting of the molten metal by extracting means pulling the elongated member directly from the mould into an inert gas flushed receiving chamber which is sealed to the mould.

Further, according to the present invention there is provided reactive metal and reactive metal alloy elongated member casting apparatus, comprising:

(a) a vessel;
(b) means for heating the metal to be cast and fused slag when placed in the vessel for melting and maintaining the metal in a molten state with a fused slag surface layer;
(c) means for blanketing the surface of the contents of the vessel with inert gas while metal therein is being melted;
(d) a mould sealed to and protruding into the vessel for receiving molten metal directly therefrom;
(e) means for cooling a downstream portion of the mould so that in operation, molten metal when fed to the mould will issue therefrom as a cast, elongated member;
(f) a receiving chamber sealed to the mould for receiving the cast elongated member therefrom;
(g) means for flushing the receiving chamber with inert gas; and
(h) extraction means in the receiving chamber, for regulating the rate of delivery of the cast elongated member therein directly from the mould thereby controlling the rate of casting.

In the process and apparatus according to the present invention the molten metal is not exposed to a vacuum, so that substantially no radiological contamination occurs of exhausted gases, nor is there any requirement for complex hardware to maintain a vacuum. The metal is instead protected from oxidation by a fluoride slag cover and, at least while it is being melted, by an inert gas blanket. Furthermore, casting is conducted in a flooded mould system with the result that level control of molten metal in the mould ceases to be a factor in the operation, and high surface qualities of the cast metal are assured; the system can be easily shut down and rendered safe in the event of any service or apparatus failure; and the continuous casting technique is such as to allow the production of a wide range of shaped or hollow sections of bar from, for example, 28 mm. strip to 150 mm., or larger, diameter bar in, for example, natural or depleted uranium, or in, for example, uranium alloys of commercial interest.

In the accompanying drawings which illustrate, by way of example, embodiments of the present invention, FIG. 1 is a diagrammatic, sectional side view of a continuous, vertical casting apparatus.

Figure 2:
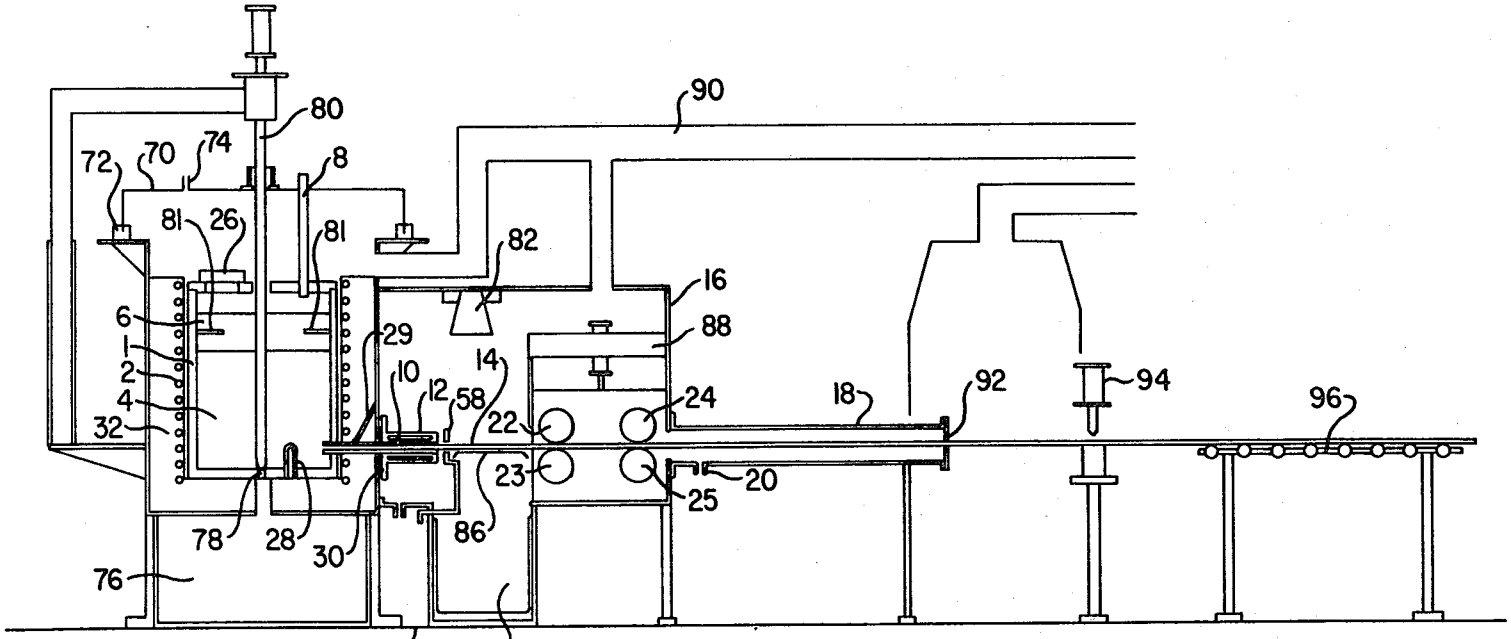

FIG. 2 is a diagrammatic, sectional side view of a continuous, horizontal casting apparatus.

In FIG. 1, there is shown a reactive metal and reactive metal alloy elongated member casting apparatus, comprising:

(a) a vessel 1, in the form of a crucible, which in this embodiment is of graphite and is, preferably internally coated with a refractory oxide, such as $ZrO_2$ or MgO, (b) means, in the form of an induction heating coil 2, for heating the metal 4 to be cast and fused slag 6 when placed in the vessel for melting and maintaining the metal 4 in a molten state with a fused slag surface layer 6, (c) means, in the form of a nitrogen gas inlet pipe 8, for blanketing the surface of the contents 4 and 6 of the vessel 1 with inert gas while the metal 4 therein is being melted, (d) a mould 10, in this embodiment of graphite, sealed to and protruding into the vessel 1, for receiving molten metal 4 directly therefrom, (e) means, in the form of a water cooled jacket 12, for cooling a downstream portion of the mould 10 so that, in operation, molten metal 4 when fed to the mould 10 will issue therefrom as a cast, elongated member 14, (f) a receiving chamber, in the form of casings 16 and 18, sealed to the mould 10 for receiving the cast, elongated member 14 therefrom, (g) means, in the form of a nitrogen gas inlet pipe 20, for flushing the casings 16 and 18 of the receiving chamber with inert gas, and (h) extraction means, in the form of extraction rolls 22 to 25, which are coupled in a conventional manner to a variable speed drive (not shown), in the casing 16 of the receiving chamber, for regulating the rate of delivery of the cast, elongated member 14 therein directly from the mould 10 thereby controlling the rate of casting.

The vessel 1 has a removable cover 26 and is provided with a thermocouple tube 28 for containing a thermocouple (not shown) for measuring the temperature of the molten metal 4. The cover 26 facilitates intermittent or continuous charging of the vessel 1 and inspecting, stirring and venting its contents. The vessel 1 has a thermocouple port 29 in its base, to facilitate measuring the temperature of the upstream end of the mould 10, and rests upon the water cooled jacket 12. The vessel 1 is cemented thereto by a layer 30 of a heat resistant cement such as the silaceous refractory mortar known as KYANEX (trade mark) obtainable from Dresser Industries Limited, Montreal, Canada.

When the apparatus shown in FIG. 1 is to be used for casting uranium, or alloys thereof, the silaceous refractory mortar 30 should be coated with a refractory oxide wash, such as $ZrO_2$ aq., before being exposed to molten uranium.

The induction heating coil 2 is embedded in a casing 32 of thermal insulating material, preferably of a mineral insulating material such as asbestos, extending around the vessel 1 and on a casing 34. The casing 34 has a liquefied or gaseous nitrogen inlet 36, an annular baffle 38 and is sealed by a sand seal 40 to a steel gas box 42 enclosing a load cell assembly 44 and rollerbearing 46. The load cell assembly 44 and hinge 46 are provided to monitor the frictional forces generated between the mould 10 and the cast, elongated member 14 during the process of extracting the cast, elongated member 14 from the mould 10, and thus to provide information by means of which the casting parameters and rates used may be continually adjusted to optimize the surface quality and rate of production of the cast, elongated member 14. The steel gas box 42 has a vent pipe 48 leading to a fume extraction hood 50 over the vessel 1.

The load cell assembly 44 and roller bearing 46 are mounted on a base 52 to which the steel gas box 42 is sealed. The load cell assembly 44 supports one side of a platform 54 which is tiltably supported on the other side by the roller bearing 46. The platform 54 has a central opening 56 for the cast, elongated member 14 issuing from the mould 10. The downstream end of the opening 56 is surrounded by a spray ring 58 for directing a radially inwardly flowing stream of liquefied or gaseous inert fluid coolant e.g. nitrogen gas against the cast, elongated member 14, which also provides an oxygen free atmosphere therearound.

The base 52 is supported by and sealed to the casing 16 which rests upon and is sealed to a floor 60. The floor 60 has an opening 62 for the cast, elongated member 14. The casing 18 is supported by and sealed to the floor 60 around the opening 62 and extends downwardly therefrom to a lower floor 64 to which it is sealed by a water-seal 66 on a foundation 68.

In operation, the apparatus shown in the accompanying drawing has been used to produce lengths of about ten feet (three meters) of $\frac{5}{8}$ inch (15.9 mm.) diameter uranium or uranium alloy bar with the casings 34, 16 and 18 continuously flushed with nitrogen or argon and with the partial pressure of oxygen in these areas monitored, by means not shown, and maintained at levels of less than 0.1 mm. Liquid or gaseous nitrogen coolant was made to impinge on the cast, elongated member 14, by means of the spray ring 58 therearound, to accelerate cooling.

The uranium or uranium alloy for the melt stock for the melt 4 in the vessel 1 may be pre-coated with, for example, a fluoride slag, although this pre-coating step, while desirable from the stand-point of minimizing oxidation losses during pre-heat, is not essential to the successful production of cast bars because a melt stock comprising discrete, solid portions of the uranium and the fluoride slag may also be used.

The fluoride slag used for uranium and uranium alloys is preferably a prepared eutectic composition of the mixture of salts $CaF_2$ and $MgF_2$ having a melting point of ~920° C. The volumetric ratio of ground slag (−60+120 mesh) to uranium used in the charge is preferably in the range 1:3 to 1:5 slag:metal.

In order to minimize heat conduction from the vessel to the mould prior to commencement of casting, a short length (not shown) or uranium bar, or uranium alloy bar of the same composition as the melt stock, in length 2 to 4 cm., of the same nominal cross-section as the bar to be cast, is preferably attached to a conventional metal starter bar (not shown) also of the same cross-section as that of the bar to be cast, and the entirety supported in position in the mould 10 by means of the extraction rolls 22 to 25. This starter piece of uranium or uranium alloy is positioned such that its upper portion, i.e. nearest the vessel 1, will subsequently melt and coalesce with the molten metal 4.

In the tests to verify the present invention the vessel 1 was packed with alternate layers of powerded fluoride slag and the prepared uranium stock to provide the molten metal 4 and fused slag surface layer 6.

As previously stated, the apparatus was flushed with nitrogen or argon until the partial pressure of the oxygen therein was less than 0.1 mm. This took between one and one and a half hours at inert gas flow rates of 1 to 10 l/minute, for example 5 l/minute.

The molten metal 4 was then melted by induction heating from the induction heating coil 2, typically 20 KW was found to melt 20 Kg of charge in thirty-five to forty minutes.

It is an important feature of this embodiment of the present invention that during the melt down stage, and the maintenance of the metal in a molten state, that there were two levels of safeguard against oxidation of the uranium. In the first instance, the uranium stock is protected mainly by the gaseous environment providing a protective inert gas blanket. As the uranium melted it gravitated to the bottom of the vessel 1 to form the molten metal 4 with the fluid slag layer 6 providing protection against oxidation by intervening between the molten uranium and the surrounding, inert atmosphere. Once the fused slag layer 6 had formed the inert gas blanket was not essential but was continued throughout the casting operation.

From the tests it was found that the molten uranium is preferably superheated in preparation for casting, and control at this stage of the operation was achieved by using a thermocouple (not shown) in the thermocouple port 28 protruding into the molten metal 4. Preferred melt temperatures for casting were found to be in the range 1200° C. to 1380° C. for substantially pure uranium, with a slightly higher range of 1250° C. to 1400° C. for some uranium base alloys.

With these preferred high temperature ranges, it was found to be desirable to prevent extensive interaction of the uranium with the graphite of the crucible forming the vessel 1 and the graphite of the mould 10. Therefore, the surfaces of the vessel 1 and the mould 10 which were to be in contact with the molten metal 4, were protected by a refractory oxide coating or an inert barrier layer of, for example, an inert ceramic oxide such as zirconium oxide. In different embodiments of the present invention the mould is protected by an inert sleeve insert of, for example, zirconium oxide, or boron nitride.

The casting was achieved by intermittent extraction of the cast, elongated member 14 issuing from the mould 10. The permissible range of extraction parameters was found to be wide and varied with the cross-section and size of the cast, elongated member 14 being cast, and the surface quality that was desired. The cycle extraction times that were used were in the range 0.05 to 0.5 seconds, with the cast velocity of the cast, elongated member 14 during extraction being between 40 and 200 mm/second. The dwell or stop part of the extraction cycle was in the range 0.5 to 4 seconds. Combinations of these parameters yielded net casting rates in the range 0.5 to 20 mm/second. Typical operating parameters for two cast member 16 sizes were:

| Cast Elongated Member | Extraction Time (seconds) | Dwell Time (seconds) | Casting Rate (mm/second) |
|---|---|---|---|
| 12 mm. dia. bar | 0.1 | 0.5 | 14 |
| 25 mm. dia. bar | 0.2 | 1.5 | 3 |

From the following it will be seen that the present invention provides a distinct improvement over the prior art in that it was found that the casting rate is not related as it has previously been to the pouring rate of the liquid metal, and may be varied independently thereof. Indeed, it was found that the casting rate may be speeded up, slowed down, or even stopped completely, at any time during the operation. This was found to vastly improve the safety aspects for casting reactive metals and alloys thereof by the process and apparatus of the present invention over those of the prior art, and was further found to afford the opportunity of adjusting the casting rates to improve the surface quality of the cast, elongated member 14 and/or its productivity.

In addition, there was afforded the opportunity to arrest casting extraction after a large fraction of the melt has been cast, and introduce new stock into the crucible. After a heating period, this new stock would be used to re-establish a full charge of molten metal 4 in the vessel 1. In this fashion, the process and apparatus according to the present invention were found to permit long production runs as described below.

After having established a steady state operational condition in the apparatus in which the slag covered liquid uranium or alloy thereof in the vessel 1 was held at the optimum temperature, and the cast, elongated member 14 in the form of a solid cast bar was being withdrawn from the system under optimum conditions for intermittent extraction, the entire system being continually flushed with inert gas, it was found that there were several options open with respect to continuing or terminating the production of the cast, elongated member 14. In order to continue casting beyond the capacity of the initial charge, it was found that, for example, additional solid, coated lump uranium or alloy thereof could be added to the vessel 1, either continuously in small amounts without interrupting casting or disturbing the thermal fields in the system, or intermittently in larger quantities in which case the casting could be arrested until the required liquid metal superheat had been reattained in the vessel 1. Using either method, it was found that no hazard was involved in disturbing the inert atmosphere above the slag layer 6 in the vessel 1 because the solid make-up material was simply lowered through the slag layer 6 to rest on side wall supports (not shown) in the vessel 1, which has previously been installed in the vessel 1 for this purpose.

To terminate the casting at any time, it was found advantageous to block the entrance to the cavity of the mould 10 in a conventional manner with a tapered, graphite plug (not shown) which was inserted through the molten metal 4. Inserting a tapered, graphite plug in this way was found to cut off the feed of molten metal to the mould 10 so that cast, elongated member 14 could be completely removed from the system.

In a further variation of the operational procedure, the casting was terminated as previously described and a new starter bar was inserted into the mould 10 and a fresh charge was added to the vessel 1. In this procedure the tapered, graphite plug was removed after the required superheat was attained in the fresh charge, and then the new starter bar was pushed into the molten metal 4 in the vessel 1 to establish the desired start-of-casting conditions once again.

Analysis of air samples obtained adjacent to the apparatus shown in FIG. 1, during operation, have shown levels of airborne uranium of the order of 30 to 50 $\mu gm/m^3$, which is approximately 50% of the maximum permissible concentration dictated by the Atomic Energy Control Board of Canada. Both $\beta$ and $\gamma$ activities in the apparatus immediately after use were found to be within what are generally regarded as acceptably safe levels for the normal handling of radioactive material.

While the casting apparatus shown in FIG. 1 is for casting vertically, the present invention can be used for casting in a horizontal direction.

Referring now to FIG. 2, similar parts to those shown in FIG. 1 are designated by the same reference numerals and the previous description is relied upon to describe them.

In FIG. 2 the mould 10, casings 16 and 18 and extraction rolls 22 to 25 are mounted to one side of the vessel 1 for casting the cast, elongated member 14 in a horizontal direction.

The vessel 1 has a removable cover 70 sealed thereto by a sand seal 72 and provided with an inert gas inlet 74. The vessel 1 is mounted above a dump pit 76 and has a dump outlet 78 and dump outlet stopper rod assembly 80 which may be actuated to release the contents, remaining in the vessel 1 after casting, through the dump outlet 78 into the dump pit 76. The vessel 1 may be provided with at least one metal addition receiving shelf 81 on which solid pieces of the metal as additions may be placed to avoid disturbing the thermal casting conditions at the bottom of the vessel 1 while at the same time ensure that the solid pieces are placed to be melted below the fused slag 6. For this reason the or each shelf is situated in the vessel 1 at a position for submersion below the level of the slag when the apparatus is in use.

While the embodiment shown in FIG. 2 is not provided with a load cell for monitoring the frictional forces generated between the mould 10 and the cast, elongated member 14, and the casing 16 contains the mould 10, a load cell arrangement could be provided in this embodiment for the same purpose as the load cell 44 in FIG. 1. The casing 16 has a fire extinguisher 82, preferably of the salt type, and a break out pit 84. The fire extinguisher is for use in the event that oxygen leak into the casing 16 and the hot portion of the cast, elongated member 14 issuing from the mould 10 react with the oxygen. The break out pit 84 is provided to receive any debris falling from the cast, elongated member 14 issuing from the mould 10. An inert gas inlet 86 is provided to the casing 16. If necessary, a support 88 may be provided along which the cast, elongated member 14 is slidably supported.

The extraction rolls 22 and 24 are shown provided with a hydraulic nip adjusting mechanism 88 for adjusting the gripping force exerted between the extraction rolls 22 to 25 on the cast, elongated member 14.

Fumes from above the vessel 1 and from the casing 16 are collected by a fume extraction system 90.

The casing 18 terminates at a finite distance from the extraction rolls 24 to 27, whereat the cooled, cast, elongated member 14 enters an air environment through a gland seal 92. A fume extraction system 94 is provided over the portion of the cast, elongated member 14 that has just emerged from the gland seal 92.

The ingress of oxygen into the outlet end of the casing 18 may also be avoided by maintaining a specific pressure differential across the point of exit of the cast, elongated member 14 therefrom, or by a gas curtain of, for example, burning methane, at this end of the casing 18.

A hydraulic chisel assembly 94 is provided for severing the cast, elongated member 14 into desired lengths on a run-out table 96.

The apparatus shown in FIG. 2 operates in a similar manner to the apparatus shown in FIG. 1.

It will be apparent to those skilled in the art that the present invention is useful for casting other reactive metals and alloys thereof, such as, for example, zirconium or beryllium, and their alloys, and that significant advantages in the metallurgical processing of these materials will accrue by using the method and apparatus of the present invention. Thus, considering, by way of example, the production of engineering artifacts in uranium and its alloys, the metallurgical and economic advantages of casting by the method and apparatus according to the present invention may be realized in the manufacture of semi-finished bar stock or welding rod, rather than by the conventional procedures of vacuum casting of ingots and their subsequent extrusion. Similarly, it would be more advantageous to cast strip and sheet according to the present invention, rather than by the conventional method of casting large slabs of the metal for subsequent hot rolling. Another example of the application of the present invention is at the pyro-metallurgical stage of extraction of uranium metal from its salts. In the present conventional practice, a contained exothermic reaction between metallic magnesium and uranium fluoride produces a body of molten metallic uranium in the reactor vessel. The resultant lump of uranium (weighing between 0.5 to 3 tons) is conventionally re-melted under vacuum to produce vacuum cast shapes. The present invention may advantageously be used in conjunction with the reduction stage of uranium production, by attaching to the reactor vessel a casting apparatus according to the present invention, to produce directly from the molten body of uranium, cast rods, billets or such shapes as may be required. In this manner, it will be possible to convert the reduction stage of operations from the present batch process, to one in which the pyrometallurgical reactants are continuously fed to a reactor chamber, and the molten uranium or uranium alloy produced may be continuously cast from the reactor, using the latter as the vessel 1 shown in FIG. 1 or 2.

It will be appreciated that, in the application of the present invention to uranium and alloys thereof, the molten metal containing members of the vessel 1, nozzle section of the mould 10 and the mould 10 itself should behave substantially non-reactive to the molten metal 4. In other embodiments of the present invention, the vessel 1 may be of a refractory material, for example, zirconia or magnesia, or could be fabricated using coatings or inserts of refractory materials on or in graphite where graphite is considered to be reactive with one or more components of the molten metal.

In other embodiments of the present invention, the casing process may be started by providing a removable plug or stopper rod closing the entry to the mould 10 during melt down and the period of superheating the molten metal 4 in the vessel 1. In this case the starter bar may be positioned in the lower, cooled portion of the mould 10 assembly, and contain a keying device on its upstream end onto which the reactive metal will solidify when the plug is removed at the start of the casting operation.

In yet other embodiments of the present invention, different means of restricting heat flow from the vessel 1 to the mould 10 prior to start-up may be employed. For example, a two part mould divided transversely to the casting direction to provide a thermal barrier between that part of the mould connected to the vessel 1 and that part being cooled, might be used to ensure melting and coalescing of the top of the reactive metal portion of the starter bar.

We claim:

1. A method of casting elongated members of reactive metals and reactive metal alloys comprising:

(a) melting the metal to be cast into a molten state in a vessel with fused slag while blanketing the surface of these contents of the vessel with inert gas;

(b) maintaining the metal in the vessel in a molten state while allowing the molten metal to flow directly from the vessel into an upstream end of a mould protruding into and sealed to a bottom portion of the vessel to maintain the upstream end of the mould flooded with molten metal;

(c) cooling a downstream portion of the mould so that the molten metal issues therefrom as a cast, elongated member; and (d) controlling the rate of casting of the molten metal by extracting means pulling the elongated member directly from the mould into an inert gas flushed, elongated member receiving chamber which is sealed to the mould.

2. A method according to claim 1 wherein the partial pressure of oxygen in the atmosphere blanketing the molten metal and the atmosphere in the elongated chamber is maintained at levels of less than 0.1 mm.

3. A method according to claim 1 wherein the step of cooling comprises directing a radially inwardly flowing stream of inert fluid coolant against the cast metal issuing from the mould.

4. A method according the claim 1 wherein the metal is uranium, the uranium stock is precoated with fluoride slag, and the vessel is packed with alternate layers of powdered fluoride slag and the coated uranium stock for the melt stock.

5. A method according to claim 1 wherein the metal to be cast is substantially pure uranium, and the temperature of the molten metal in the vessel during casting is in the range 1200° C. to 1380° C.

6. A method according to claim 1 wherein the metal to be cast is a uranium base alloy, and the temperature of the molten metal in the vessel during casting is in the range 1250° C. to 1400° C.

* * * * *